United States Patent [19]

Norihiro

[11] Patent Number: 4,661,008

[45] Date of Patent: Apr. 28, 1987

[54] JOINT STRUCTURE FOR CHANNELS

[76] Inventor: Umezawa Norihiro, 6-3, Aza-Uramachi, Kakuda, Kakuda-shi, Miyagi 981-15, Japan

[21] Appl. No.: 787,697

[22] Filed: Oct. 15, 1985

Related U.S. Application Data

[63] Continuation of Ser. No. 427,589, Sep. 29, 1982, abandoned, which is a continuation of Ser. No. 169.113, filed as PCT JP79/00077, Mar. 26, 1979, published as WO 79/00848, Nov. 1, 1979, abandoned.

[51] Int. Cl.[4] ..... F16B 7/00

[52] U.S. Cl. ..... 403/294; 403/300

[58] Field of Search ..... 403/393, 394, 188, 388, 403/300, 294, 363, 343, 406.1, DIG. 1

[56] References Cited

U.S. PATENT DOCUMENTS

| | | | |
|---|---|---|---|
| 2,584,709 | 2/1952 | Johnson | 403/393 X |
| 2,849,105 | 8/1958 | Touton | 403/294 X |
| 2,863,683 | 12/1958 | Peterson et al. | 403/388 X |
| 3,006,443 | 10/1961 | Siler | 403/410 X |
| 3,257,720 | 6/1966 | Siler | 403/405 X |
| 3,305,995 | 2/1967 | Armstrong et al. | 403/408 X |
| 3,413,813 | 12/1968 | Rock et al. | 403/294 X |
| 4,145,859 | 3/1979 | Ollinger | 52/726 X |

FOREIGN PATENT DOCUMENTS

| | | | |
|---|---|---|---|
| 56325 | 6/1939 | Denmark | 403/343 |
| 2249963 | 9/1973 | Fed. Rep. of Germany | 403/294 |
| 5835 | 1/1978 | Japan . | |
| 73843 | 6/1978 | Japan . | |
| 111633 | 9/1978 | Japan . | |
| 585631 | 12/1977 | U.S.S.R. | 403/294 |

*Primary Examiner*—Andrew V. Kundrat
*Attorney, Agent, or Firm*—Martin Smolowitz

[57] ABSTRACT

A joint structure for channels used in agriculture, industry etc. which is constructed for connecting a number of concrete units to each other. The joint structure strengthens the resistance of channel both to sinking and upheaval.

Neighboring concrete units are interconnected by connector plates and two fasteners passing through fastener holes formed on each end of the connector plate. An eccentric washer plate fitted on the fastener is urged against both a stop flange disposed between the fastener holes and another stop flange disposed at the lateral outside of the fastener hole of the slot type.

12 Claims, 27 Drawing Figures

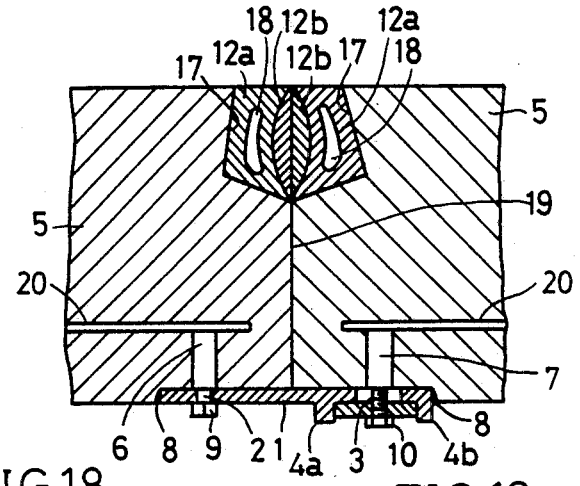
FIG.17
FIG.18
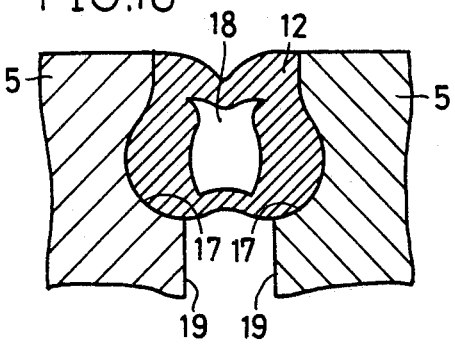
FIG.19
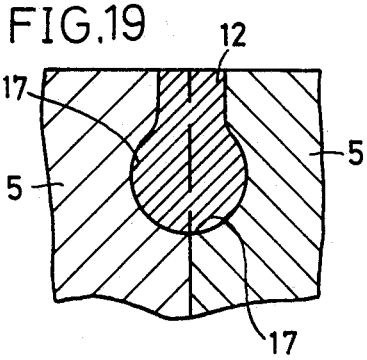
FIG.20
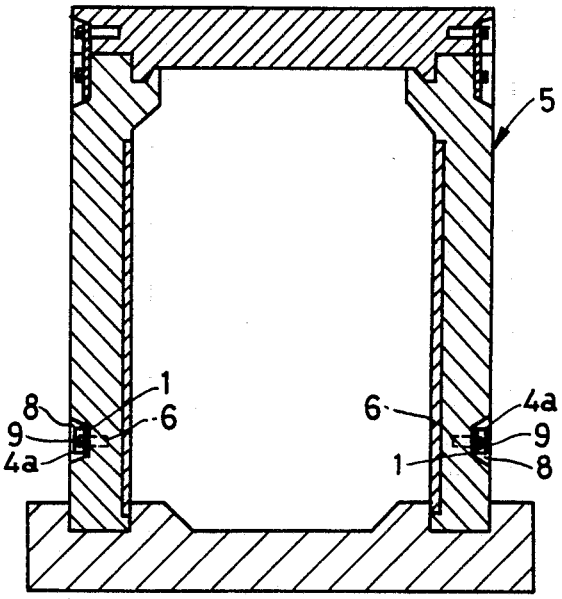

JOINT STRUCTURE FOR CHANNELS

This application is a continuation, of application Ser. No. 427,589, filed Sept. 29, 1982 now abandoned, which is a continuation of Ser. No. 169,113 filed as PCT JP 79/00077, Mar 29, 1979, published as WO 79/00848, Nov. 1, 1979 now abandoned.

DESCRIPTION

1. Technical Field

The present invention relates to a joint structure for flumes or channels used in agriculture, industry, etc. more particularly, to joint structure for channels which are constructed by connecting a number of prefabricated concrete products or units with each other.

2. Background Art

In general, channels are composed of concrete units interconnected in regular order, which have various cross sections such as U-shaped, circular pipe-shaped, square pipe-shaped, L-shaped and so forth, corresponding to the use and location of the channel concerned. There recently has been proposed a new joint structure using an eccentric washer plate.

Referring to FIGS. 1 and 2, the abovementioned joint structure comprises an upper connector plate 1*a*, a lower connector plate 1*b*, each connector plate being provided with fastener holes 2 and 3 on each end portion, a stop flange 4 formed on each connector plate at the lateral outside of the fastener hole 3, of slot type, an insert 6 of nut type embedded in a recess 8 formed on the one end of an upright wall of a concrete unit 5, another insert 7 of the same type embedded in another recess 8 formed on the other end of the wall, each recess being adapted to receive the connector plate, a bolt 9 to be screwed into the insert 6 through the hole 2, another bolt 10 to be screwed into the insert 7 through the hole 3, and an eccentric washer plate 11 to be fitted on the bolt 10, and the periphery of the washer plate 11 is urged against the inner side of the stop flange 4 after the neighboring concrete units are abutted to each other.

Referring to FIG. 3, when consolidation sinking in a channel of a certain span occurs, internal stress at section A–A′ is compressive stress at its upper part, while it is tensile stress at its lower part, as shown in FIG. 4. In the case of the channel adopting the joint structure of the eccentric washer type, it follows that, as the tensile stress is borne by the stop flange 4 of the lower connector plate 1*b*, the eccentric washer plate 11 contacting thereto, and the bolts 9, 10 passing through the fastener holes 2, 3 and collapse of the channel body can be restrained to a minimum. However, because the stop flange 4 of the upper connector plate 1*a* and the washer plate 11 contacting thereto, are disposed so that they do not bear any compressive stress, the compressive stress is solely borne with the upper portion of the joining end of the concrete unit 5. Accordingly, collapse or buckling of concrete in the upper part occurs when the compressive stress therein exceeds the permissible compressive stress of concrete body, owing to considerable consolidation sinking.

On the contrary, when an upheaval of a channel occurs as shown in FIG. 5, the internal stress at the section A–A′ is tensile stress at its upper part, while it is comressive stress at its lower part, as shown in FIG. 6. As the tensile stress in the upper part is borne with the stop flange 4 of the upper connector plate 1*a*, the eccentric washer plate 11 contacting thereto, and the bolts 9 and 10 passing through the connector plate 1*a*, it is possible to restrain the damage of concrete and breaking the joint to a minimum. However, the compressive stress in the lower part is solely borne by the lower portion of the joining end face of the concrete unit 5, because the stop flange 4 of the lower connector plate 1*b* and the eccentric washer plate 11 contacting thereto are disposed so that they never bear the compressive stress in the upper part. Consequently, when the upheaval exceeding the permissible compressive stress of concrete occurs, it causes buckling and collapse of the concrete.

An object of the present invention is, therefore, to provide a joint structure of eccentric washer plate type which is strong against both upheaval and sinking of the channels being connected.

SUMMARY OF INVENTION

The joint structure of eccentric washer plate type of the present invention comprises a connector plate formed with two fastener holes, one of the fastener holes being of a slot type, and two stop flanges, and an eccentric washer plate of which the periphery is urged with against both stop flanges, one of the stop flanges being disposed between the fastener holes. Thus, destruction in the end portion of the concrete channel units and leakage of water owing to substantial breakage of the joint never occurs, because the eccentric washer plate can bear either compressive stress and tensile stress by pressing or pushing against the corresponding stop flange, even if either sinking and upheaval occurs in the channel.

BRIEF DESCRIPTION OF DRAWINGS

FIG. 17 is a cross sectional view of the seal members of FIG. 14 which are already compressed, FIG. 18 is a cross sectional view of the seal members of FIG. 15 which are yet uncompressed, and FIG. 19 is a cross sectional view of the seal members of FIG. 15 which are already compressed.

FIG. 20 is a longitudinal sectional view of a prefabricated channel of which all units are assembled and joined to each other.

BEST MODE OF THE INVENTION

Figure 1:
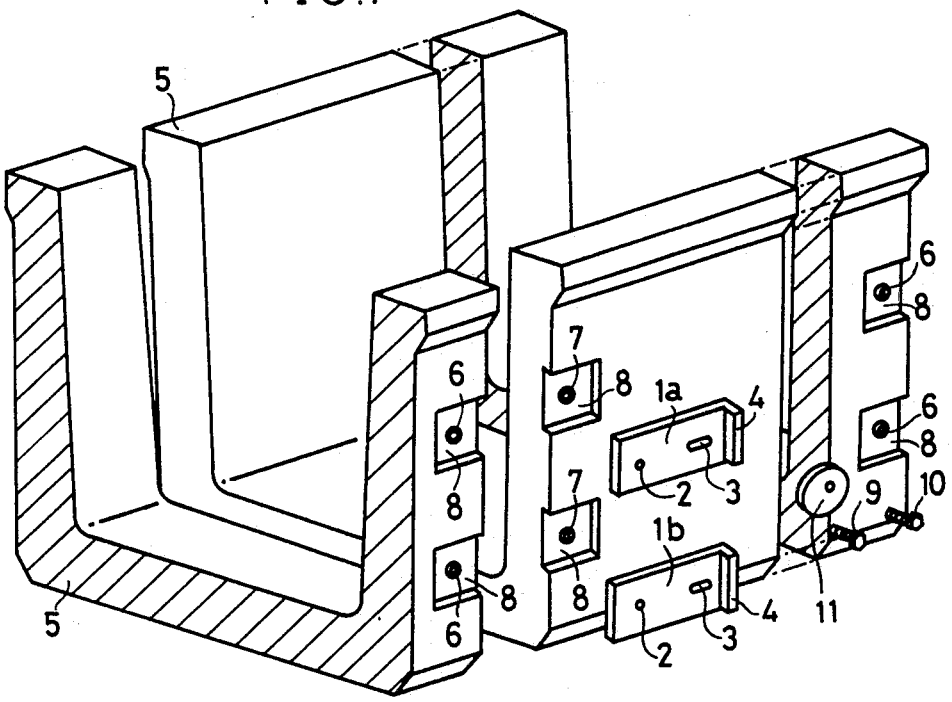
FIG. 1 is a perspective view of a channel of U-shaped section adopting a joint structure of the prior art in which concrete channel units are yet upjoined.
Figure 2:
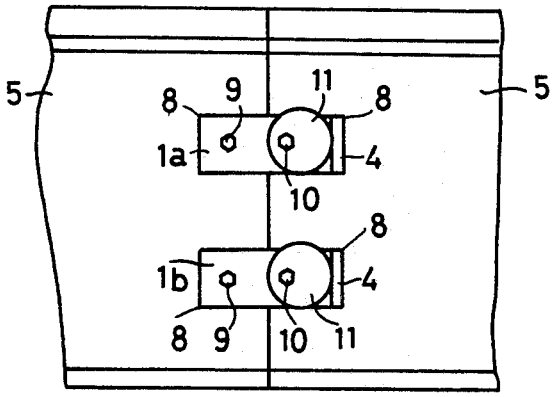
FIG. 2 is a front view of an important portion of the channel shown in FIG. 1 in which the concrete channel units are already joined.
Figure 3:
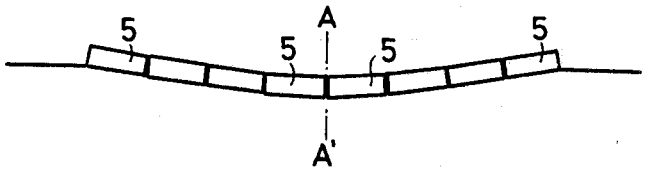
FIG. 3 is a front view of the channel of FIG. 1 which is sunk.
Figure 4:
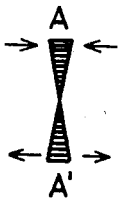
FIG. 4 shows the distribution of internal stress in section A–A′ in FIG. 3.
Figure 5:
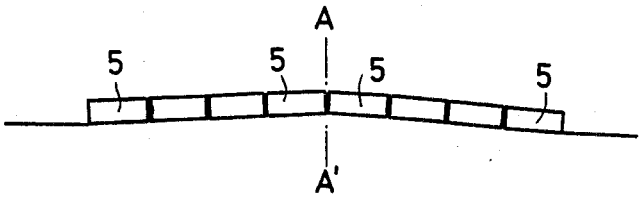
FIG. 5 is a front view of the channel of FIG. 1 which is upheaved.
Figure 6:
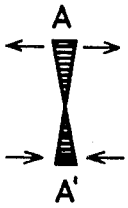
FIG. 6 shows the distribution of internal stress in section A–A′ in FIG. 5.
Figure 7:
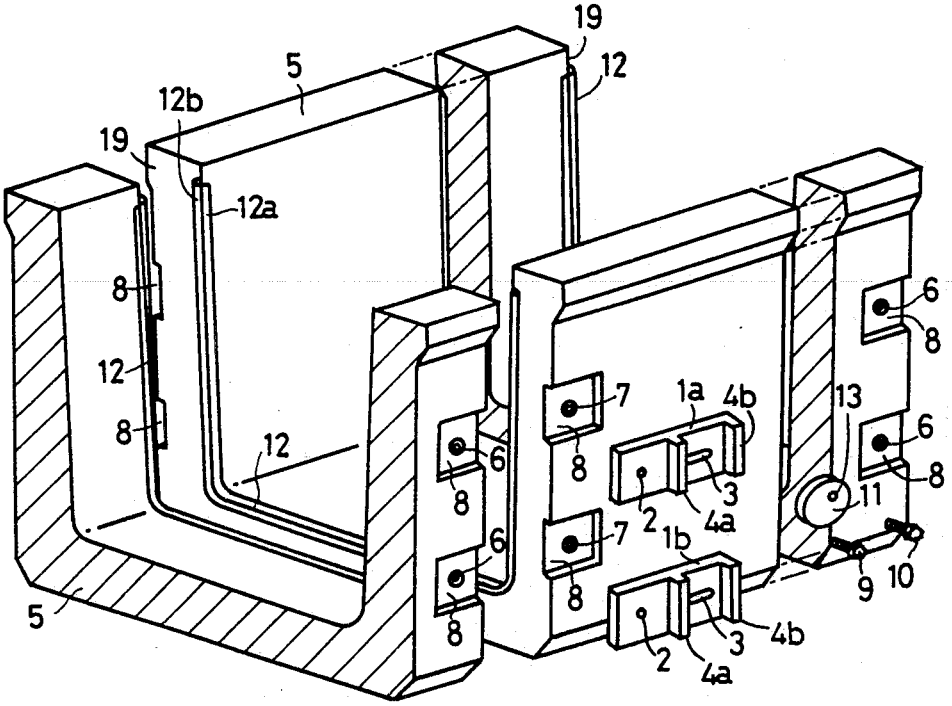
FIG. 7 is a perspective view of a channel adopting a joint structure of an embodiment of the present invention in which concrete channel units yet unjoined.
Figure 8:
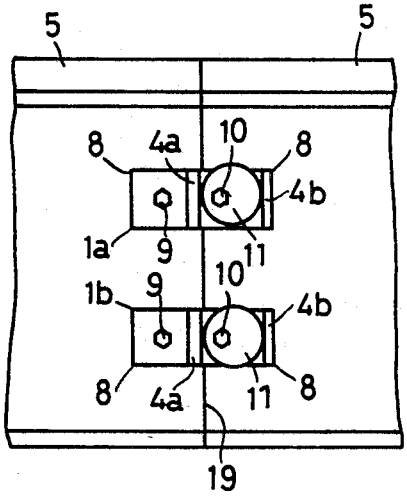
FIG. 8 is a front view of an important portion of the channel of FIG. 7 in which the concrete channel units are already joined to each other.

Describing the present invention more particularly in accordance with the accompanying drawings, in the case of the first embodiment shown in FIG. 7, each concrete channel unit 5 is U-shaped, and provided with rectangular recess 8 on each outer surface of the front and rear joining ends. Inserts 6 and 7 take the form of nuts and are embedded into the central portions of the rear and front recesses 8 and 8, respectively. Each connector plate 1*a* and the lower connector plate 1*b* is provided with two fastener holes 2 and 3, and the hole 3 is of an oblong slot type in order to leave an adjusting margin. Each of the connector plates 1*a* and 1*b* has an inner stop flange 4*a* and an outer stop flange 4*b* each taking the form of lengthwise rib. In the present embodiment, each of fasteners 9 and 10, which passes through the fastener holes 2 and 3 respectively, takes the form of a bolt.

Figure 9:
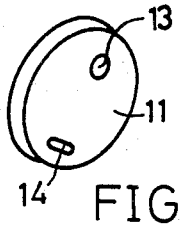
FIG. 9 is a perspective view of an eccentric washer plate used in the joint structure of the invention.
Figure 10:
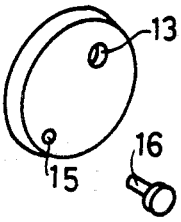
FIG. 10 is a perspective view of another eccentric washer plate used in the joint structure of the present invention.

In constructing a channel, the ends of concrete units 5 are disposed adjacently, and then both connector plates 1*a* and 1*b* are fitted into the front recess 8 of one aof the adjacent or neighboring units and the rear recess 8 of the other unit which just intercommunicate each other. While the bolt 9 screwed into the insert 6 through the fastener hole 2 is completely tightened at first, another bolt 10 screwed into the insert 7 through the fastener hole 3 of slot type is never completely tightened at first. After one of the neighboring units 5 and 5 is pressed against the other of them so that the seal members 12 and 12 of a definite form set up in a factory are fully compressed, an eccentric washer plate 11 fitted on the bolt 10 at its eccentric axial hole 13 is rotated around the bolt 10 so that the periphery of the eccentric washer plate 11 is urged against both stop flanges 4*a* and 4*b*. After finishing the above operations, the bolt 10 is completely tightened. For the purpose of rotating the eccentric washer plate 11 easily and precisely, an operator projection 14 may be formed or mounted on the front face of the washer plate 11 as shown in FIG. 9, or a hole 15 for receiving an operting member such as a pin, a nail and the like, may be formed in the eccentric washer plate 11 as shown in FIG. 10. The nut type inserts 6 and 7 each cooperate with suitable elongated means 20 in the concrete as shown in FIG. 17 so as to bear compressive and tensile stresses.

As mentioned, in the case of the joint structure of the invention, each connector plate is provided with two stop flanges, namely, inner stop flange 4*a* disposed between the fastener holes 2 and 3 and the outer stop flange 4*b* disposed at the lateral outside of the fastener hole 3, and the eccentric washer plate 11 fitted on the fastener 10 passing through the fastener hole 3 is adapted to be urged against stop flanges both 4*a* and 4*b*. Consequently, where the upper connector plate 1*a* and the lower connector plate 1*b* are used, and when consolidation sinking in the channel occurs the compressive stress in the upper part is borne with the upper connector plate 1*a*, the inner stop flange 4*a* of the plate 1*a*, the upper eccentric washer plate 11, and the bolts passing through the connector plate 1*a*, while the tensile stress in the lower part is borne with the lower connector plate 1*b*, the outer stop flange 4*b* of the plate 1*b*, the lower eccentric washer plate 11 and the botls passing through the connector plate 1*b*.

On the other hand, when upheaval occurs in the channel, the tensile stress in the upper part is borne by the upper connector plate 1*a*, the outer stop flange 4*b* of the plate 1*a*, the upper eccentric washer plate 11 and the bolts passing through the connector plate 1*a*, while the compressive stress in the lower part is borne vy the lower connector plate 1*b*, the inner stop flange 4*a* of the plate 1*b*, the lower eccentric washer plate 11 and the two bolts passing through the connector plate 1*b*.

In this way destruction, such as buckling and collapse of concrete unit end portions and large breakage of joints by which the channel may forfeit its function dots not occur, because the compressive stress and the tensile stress is fully borne by the connector plate formed with two stop flanges, the eccentric washer plate pressing or urging against the stop flanges and so forth in either case of sinking and upheavel. After all, the present invention provides a joint structure having a greater resistance to both sinking and upheaval.

Figure 21:
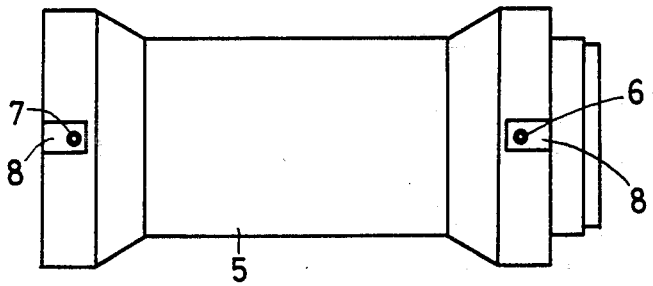
FIG. 21 is a plane view of a channel unit of circular pipe form adopting the joint structure of the present invention.
Figure 22:
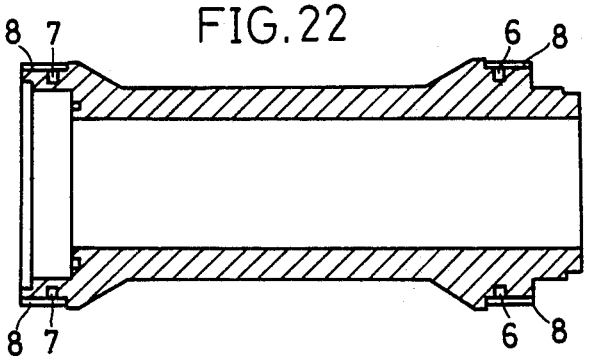
FIG. 22 is a longitudinal section of the channel unit of FIG. 21.
Figure 23:
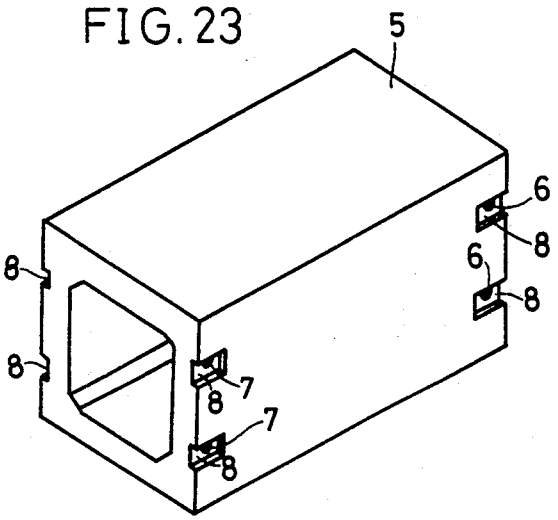
FIG. 23 is a perspective view of a channel unit of angular pipe form adopting the joint structure of the invention.
Figure 24:
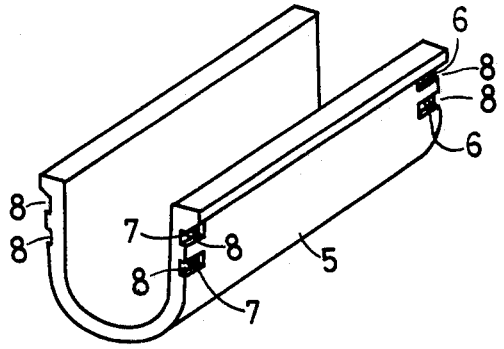
FIG. 24 is a perspective view of a channel unit of which the bottom portion is of semicircular section.

Other embodiments of the invention illustrate an insert of bolt type which may be embedded in a concrete unit in place of the insert of nut type used in the abovementioned embodiment, replacing a bolt as fastener by a nut. A concrete unit for a channel is not restricted to the unit of a U-shaped section. The invention is applicable to other known concrete units of circular pipe form as shown in FIG. 21, box or square pipe form shown in FIG. 23, channel form of which the bottom portion is semicircular as shown in FIG. 24, L-shaped form and so on. In addition, the invention is applicable not only to an originally intergrated or undivided unit but also to a prefabricated unit as shown in FIG. 20.

Figure 11:
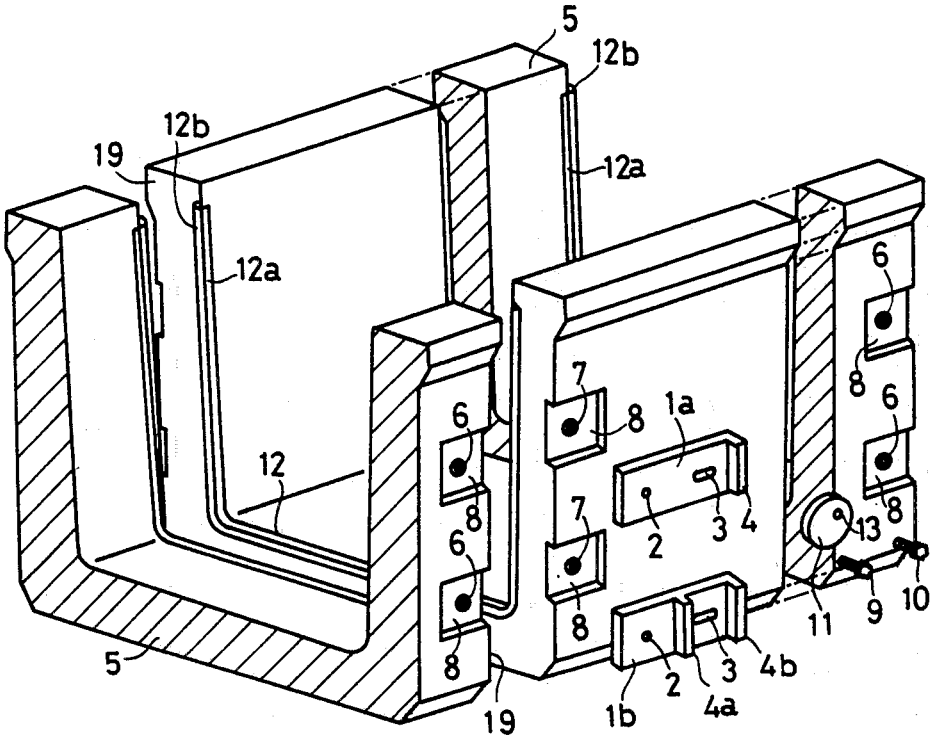
FIG. 11 is a perspective view of a channel adopting a joint structure of other emobodiment of the present invention in which concrete units are yet unjoined.
Figure 12:
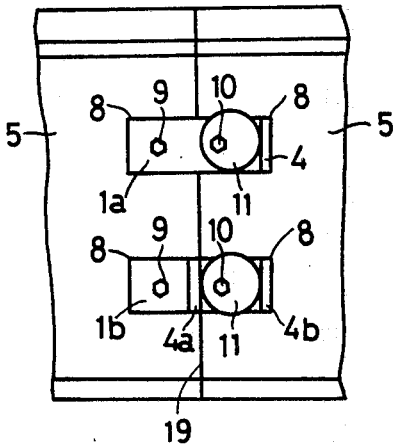
FIG. 12 is a front view of an important portion of the channel of FIG. 11 in which the concrete units are already joined.
Figure 13:
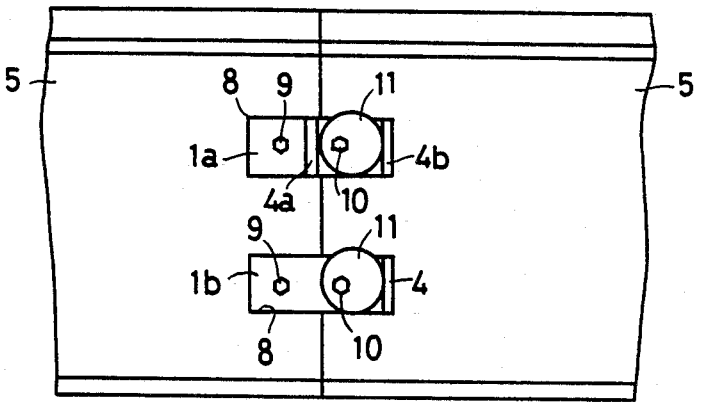
FIG. 13 is a front view of an important portion of a joined channel adopting a joint structure of a further embodiment of the invention.

Although two connector plates 1*a* and 1*b* are used in the above embodiment, the mounting number of connector plate is increased or decreased according to the weight and size of concrete units being interconnected. Also, the mounting position of the connector plate is not limited to the side surface, and the bottom surface and the top end surface of the concrete unit may be ued selectively as the mounting place. Where two connector plates 1*a* and 1*b* are used, two stop flanges 4*a* and 4 *b* may be formed or mounted only on one of them as shown in FIGS. 11 and 13.

Figure 14:
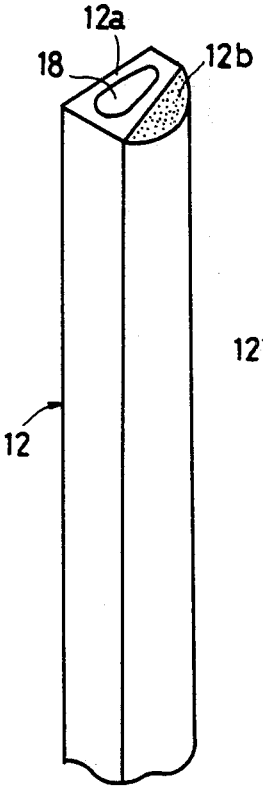
FIG. 14 is a perspective view of a seal member taking a definite form which is used in the joint structure of the invention.
Figure 15:
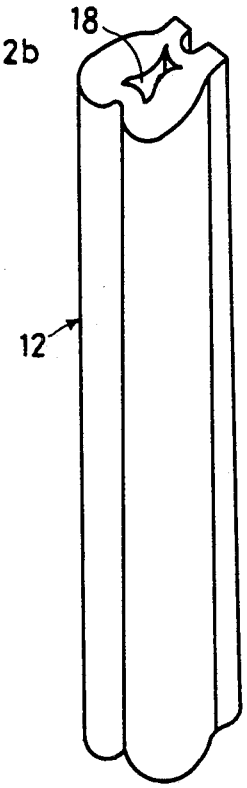
FIG. 15 is a perspective view of another seal member taking a definite form, which is used in the joint structure of the invention.
Figure 16:
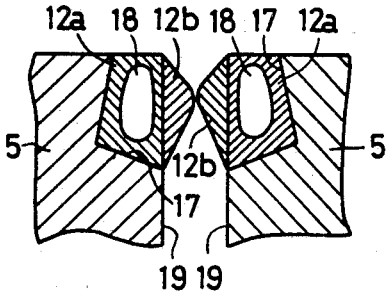
FIG. 16 is a cross sectional view of the seal members of FIG. 14 which are yet uncompressed.
Figure 25:
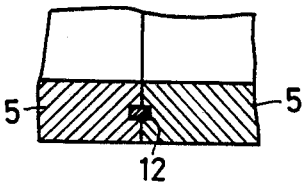
FIG. 25 is a cross sectional view of the joining ends of concrete units, showing a mounting position of a seal member taking a definite form.
Figure 26:
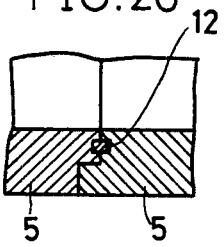
FIG. 26 is a cross section view of the unit ends, showing another mounting position of a seal member taking a definite form.
Figure 27:
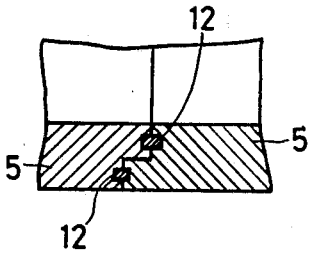
FIG. 27 is a cross sectional view of the unit ends, showing other mounting position of members taking a definite form.

As aforesaid, used of the member 12, taking a definite form, which is set up previously in a factory and compressed at the stage of channel construction, is very advantageous, because it renders such previous treatment as scraping and drying of the joining end face needless. Also all of construction operations can be done accurately and efficiently without being influenced by weather conditions such as rain and snowing, and also, because the groove dug to receive channel units can be filled up immediately after the constructing operations are finished. FIGS. 14 and 15 exemplify the preferable embodiments of the seal member taking a definite form. These seal members are made from chloroprene rubber having good weather-proof and chemicals-proof. The seal member of FIG. 14, comprises a solid body 12*a* having a hollow 18, and a crescent-shaped sponge portion 12*b* attached to the one side of the solid body 12*a*. The seal member of FIG. 15 is wholly formed out of sponge rubber. In this embodiment, the seal member 12 is fitte on the inner edge of the joining end face 19, namely, a receiving groove 17 formed on the edge portion of the water-flowing side, as shown in FIG. 16 and 18. In any way, the seal member of a definite form should have a sectional shape adapted to obtain a sufficient amount of compression correspondingly to the volume of joint between the units, so that the water-stopping function can be entirely maintained by filling up the breakage or disjuction of the joint due to the restorative expansion of the compresed portion. In addition, the mounting position and number of seal members may be changed according to the size of unit and the shape of the joining end as shown in FIG. 25, 26 and 27.

Regarding industrial applicability of the invention, the joint structure of eccentric washer plate type is useful particularly in constructing channels for agriculture, industry and so forth, which have a greater resistance both to sinking and upheaval and are fully protected against leakage of water.

What is claimed is:

1. A joint structure for connecting channel units, comprising: at least one connector plate formed to have two stop flanges and two fastener holes with one of the fastener holes being of a slot type, one of the stop flanges being disposed between the fastener holes, and the other stop flange being disposed at the lateral outside of the slot type fastener hole; a fastener passing through each fastener hole for fastening the connector plate to abutted ends of the adjoining channel units; and an eccentric washer plate being fitted on the fastener passing through the slot type fastener hole and disposed between said stop flanges, so that the periphery of said washer plate is urged against at least one of the stop flanges.

2. The joint structure of claim 1, wherein two connector plates are used for each joint structure.

3. The joint structure of claim 1, wherein at lest one compressible seal member is provided between the abutted ends of said adjoining channel units.

4. The joint structure of claim 3, wherein said seal member is made of compressible rubber.

5. The joint structure of claim 1, wherein the connected channel units are U-shaped.

6. The joint structure of claim 1, wherein said eccentric washer is urged against both stop flanges.

7. The joint structure of claim 1, wherein said fasteners are each screwed into nut type inserts embedded into the channel units.

8. The joint structure of claim 7, wherein the channel units are composed of concrete.

9. A joint structure for connecting together channel units, comprising: at least one connector plate formed to have two stop flanges and two fastener holes therein, one of the two fastener holes being of a slot type and one of the stop flanges being disposed between said fastener holes, and the other stop flange being disposed at the lateral outside of the slot type fastener hole; nut type inserts embedded in the adjoining ends of adjacent channel units, fasteners passing through said fastener holes and being screwed into said inserts for fastening the connector plate ot adjoining ends of adjacent channel units; and an eccentric washer plate being fitted on the fastener passing through the slot type fastener hole disposed between said stop flanges, so that the periphery of said washer plate is urged against at least one of said stop flanges.

10. The joint structure of claim 9, wherein said washer plate is provided with projection means for use in rotating the washer plate and for urging it against said stop flange.

11. A joint structure for connecting together the adjoining ends of channel units, comprising:

(a) at least one connector plate formed to have two stop flanges and two fastener holes, one of the fastener holes being of a slot type, one of the stop flanges being disposed between the fastener holes and the other stop flange being disposed at the lateral outside of the slot type fastener hole;

(b) least two internally threaded nut type inserts embedded into the adjoining ends of the adjacent units being joined and in alignment with said connector holes;

(c) a fastener passing through each fastener hole and being screwed into said inserts for fastening said connector plate to the adjoining ends of the channel units; and (d) an eccentric washer plate bieng fitted on the fastener passing through the slot type fastener hole and disposed between said stop flanges, the periphery of said washer plate being urged against either of said stop flanges.

12. The joint structure of claim 11, wherein said eccentric washer is urged against both stop flanges.

* * * * *